US005342077A

United States Patent [19]

Abondance

[11] Patent Number: 5,342,077

[45] Date of Patent: Aug. 30, 1994

[54] SNOW SURFBOARD HAVING ASYMMETRIC CHARACTERISTICS

[75] Inventor: Roger Abondance, La Murette, France

[73] Assignee: Skis Rossignol S.A., Voiron, France

[21] Appl. No.: 738,379

[22] Filed: Jul. 30, 1991

[30] Foreign Application Priority Data

Jul. 30, 1990 [FR] France ..... 90 09921

[51] Int. Cl.[5] ..... A63C 5/06

[52] U.S. Cl. ..... 280/602; 280/142

[58] Field of Search ..... 280/602, 14.2, 608, 280/609, 809, 610; 441/68, 74, 79

[56] References Cited

U.S. PATENT DOCUMENTS

| | | | |
|---|---|---|---|
| 3,537,717 | 11/1970 | Carldwell | 280/602 |
| 3,747,947 | 7/1973 | Gunzel | 280/602 |
| 4,071,264 | 1/1978 | Legrand et al. | 280/602 |
| 4,300,786 | 11/1981 | Alley | 280/602 |
| 4,697,820 | 10/1987 | Hayashi et al. | 280/602 |
| 4,848,784 | 7/1989 | Scherubl | 280/602 |
| 4,969,655 | 11/1990 | Katz | 280/14.2 |

FOREIGN PATENT DOCUMENTS

| | | | |
|---|---|---|---|
| 187028 | 10/1956 | Austria | 280/602 |
| 0325546 | 7/1989 | European Pat. Off. . | |
| 0362782 | 4/1990 | European Pat. Off. | 280/14.2 |
| 3919010 | 1/1990 | Fed. Rep. of Germany | 280/602 |
| 2575393 | 7/1986 | France . | |

OTHER PUBLICATIONS

"Surf Des Neiges", J. Maruzzi and J. F. Causse, Ed. Gleant, 1958, pp. 90–91.

*Primary Examiner*—Richard M. Camby
*Attorney, Agent, or Firm*—Browdy and Neimark

[57] ABSTRACT

A snow surfboard having symmetric construction, but endowed with asymmetric characteristics, a vibration absorption device, composed of at least one vibration absorption element (7, 8), inside or outside of surface (9) of the surfboard, having a relatively small mass, positioned asymmetrically so as to cause vibrations to be absorbed predominantly on the back side (4).

20 Claims, 2 Drawing Sheets

SNOW SURFBOARD HAVING ASYMMETRIC CHARACTERISTICS

FIELD OF INVENTION

This invention pertains to a snow surfboard, sometimes called a "snowboard," having asymmetric characteristics.

BACKGROUND OF INVENTION

Unlike the ski or monoski, the gliding board which constitutes the platform of a snow surfboard is used asymmetrically, because the user's body and thus his feet are not directed along the longitudinal axis of the board; instead, the feet are positioned at a sharp slant with respect to this axis. The snow surfer's body is placed askew of his board, either with the right foot in back and the left foot in front for right-footed persons ("regular foot"), or with the left foot in back and the right foot in front for left-footed persons (so-called "goofy foot") .

The distance between the feet depends on the morphology of the user, and essentially on his/her size. The feet are not perpendicular to the longitudinal axis of the surfboard, but the toes are essentially turned towards the front of the surfboard, this orientation being indicated by an angle measured from the line perpendicular to the longitudinal axis of the surfboard. This orientation can generally vary between approximately 0 to 40 degrees for the back foot, and between 10 and 45 degrees for the front foot, the most popular position for most competent surfers presently being the "intermediary" position, namely back foot: orientation angle between 10 and 15 degrees;

front foot: orientation angle between 30 and 45 degrees.

In any event, the surfer's body is askew with respect to the surfboard and the direction in which it is moving. Turns are made either by leaning the body forward, towards the toes (known more simply as the toe side or "front side"), or by leaning back towards the heels (or the "back side"). The surfer's center of gravity thus moves along an axis whose orientation substantially bisects the angle formed by the surfer's feet. The construction of snow surfboards, which initially was oriented towards symmetric surfboards (after the fashion of wave surfboards and skateboards), now tends increasingly to be oriented towards surfboards having asymmetric dimension lines. A few printed publications already exist in this sense, in particular:

The article in the French magazine "WIND SURF NEIGE," Special Edition 11, 1989, page 20: "Scoop: le surf total" ["Scoop: the Total Surfboard"];

Document EP-A-0325 546;

"Surf des neiges" ["Snow Surfboard"] by J. Maruzzi and J. F. Causse, Editions Glënat, 1958, pages 90–91.

The constructions proposed by these publications have the disadvantage of requiring a specific configuration for the "regular" position and another configuration for the "goofy" position, which requires producers to use more equipment and presents some production problems. The result is a higher production cost for the surfboard.

SUMMARY OF INVENTION

An object of the invention is to correct this problem. To this end, the present invention pertains to a snow surfboard whose configuration is totally symmetric with respect to its median longitudinal axis, but which, in order to give it asymmetric behavior characteristics, is endowed with a vibration absorption device having a relatively small mass composed of at least one vibration absorption element inside or outside of the body of the surfboard, and which can comprise any of a number of elements known per se in other fields, including:

a piece of viscoelastic material lodged in the surfboard structure;

a vibration absorption system composed of cables embedded in a viscoelastic strip and positioned inside the structure of the surfboard; or a vibration absorption system composed of at least one layer of viscoelastic material held in place by a high elasticity module plate and mounted on the upper surface of the surfboard.

Such vibration absorption element is positioned asymmetrically with respect to the longitudinal median plane of the surfboard, so that it absorbs vibrations predominantly at the heel or back side of the surfboard.

BRIEF DESCRIPTION OF DRAWING

The invention will be more clearly understood and its advantages and additional characteristics will emerge in the description below of a few embodiments of the snow surfboard, which, although having an essentially symmetric structure, presents asymmetric characteristics, with reference to the accompanying schematic drawing, wherein.

DETAILED DESCRIPTION OF EMBODIMENTS

Figure 1:
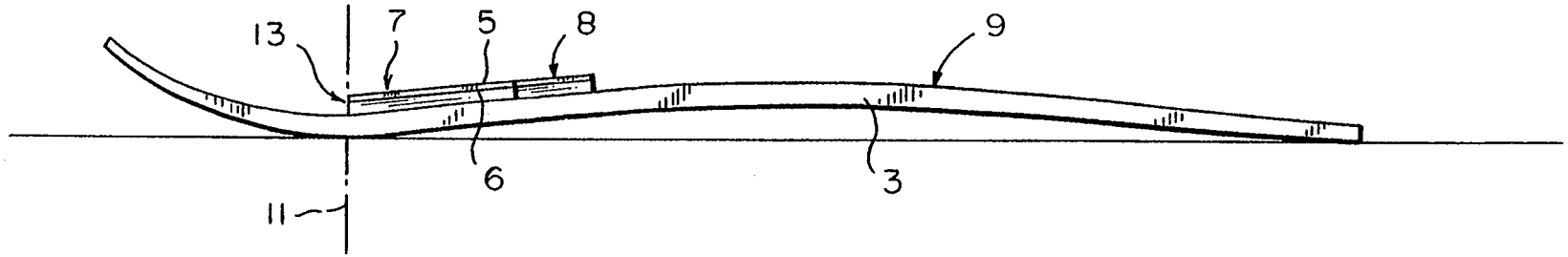
FIG. 1 is a profile view of a first embodiment of a snow surfboard in accord with the present invention.
Figure 2:
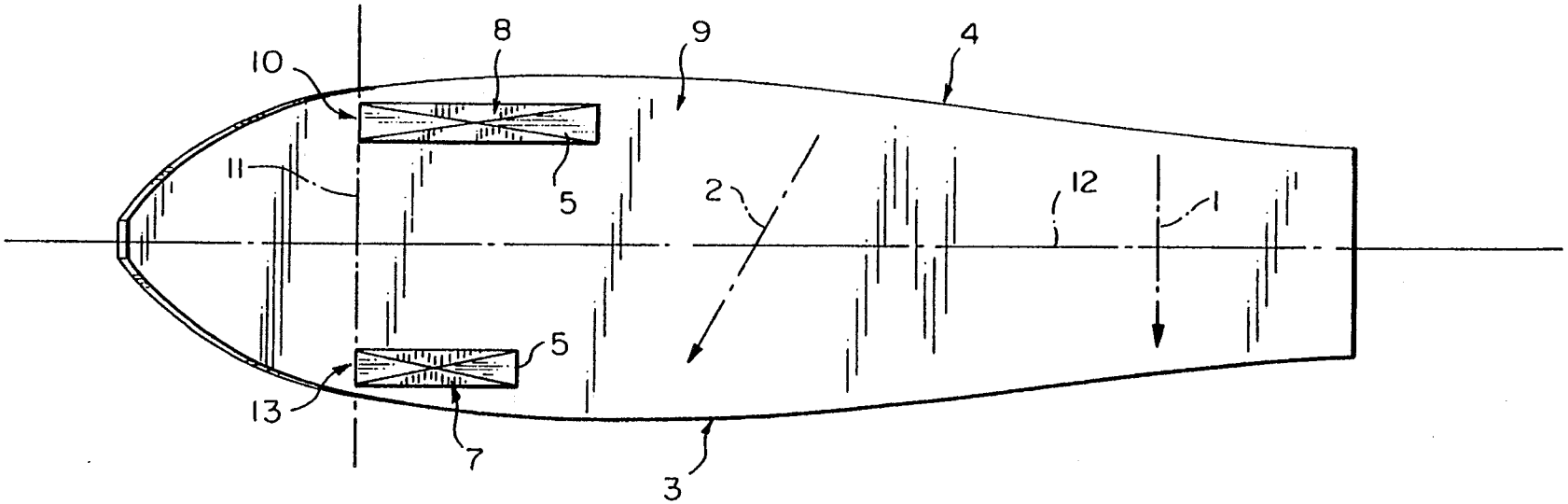
FIG. 2 is a top view thereof.

With reference to FIGS. 1 and 2, there is illustrated an example of a snow surfboard for left ("goofy") footed individuals, with the left foot in back, the toes being pointed according to 1 towards left side 3 of the surfboard on the toe or front side, and the right foot in front, pointed according to 2 towards the same front side 3, opposite side 4 thus being the heel, or back side.

The gliding board itself of this snow surfboard is fully conventional, i.e. of totally symmetric construction. On the other hand, in order to give it the presently desired asymmetric characteristics, two vibration absorbers 7, 8 with rigid metal stress plate 5 and viscoelastic material 6 are mounted on upper surface 9 of the gliding board, these vibration absorbers having a relatively small mass with respect to the gliding board and being known in and of themselves, for example, being described in FR-A-2,575,393; U.S. Pat. No. 3,537,717 in which they are used as vibration absorbers for alpine skis.

Vibration absorber 7 is positioned on front side 3, to the left of longitudinal axis 12 of the surfboard, while vibration absorber 8 is positioned on back side 4 as shown in the drawing, and the latter vibration absorber 8, according to an essential aspect of the invention, is larger than vibration absorber 7: this dimensional asymmetry of the two vibration absorbers gives this surfboard the desired characteristics of behavioral asymmetry.

Typically, and in a completely unrestrictive manner, the surfboard shown, which yielded highly satisfactory test results, is a completely symmetric 173 cm surfboard, on which two conventional "long-limbed" vibration absorbers 7, 8 were mounted near the board tip, these absorbers having"zicral" plate 5 and viscoelastic material 6, whose outside dimensions are as follows:

vibration absorber 7 (front side): length: 240 mm; width: 55 mm, distance from side 3: approximately 25 mm;

vibration absorber 8 (back side): length: 340 mm; width: 55 mm; distance from side: approximately 25 mm.

These two vibration absorbers 7, 8 are mounted parallel to each other and their front edges 13, 10 are both aligned in this example with the front line of contact 11 of the surfboard.

Of course, the invention is not limited to the sample embodiment described above. In this way, this surfboard could, while having a perfectly symmetric outside appearance, comprise an inside vibration absorption system (embedded in the structure of the surfboard), placed asymmetrically with respect to its median longitudinal plane., and composed of the following:

either a piece of viscoelastic material lodged in the structure of the surfboard; or a vibration absorber comprising cables embedded in a viscoelastic strip and positioned in the structure of the surfboard.

In this way, the surfboard could also comprise at least one front side vibration absorber with stress plate, and/or at least one other vibration absorber of this type but having larger dimensions on the back side, the essence being that,,generally speaking, the vibration absorption incidence thus created must be greater on the back side than it is on the front side.

Figure 3:
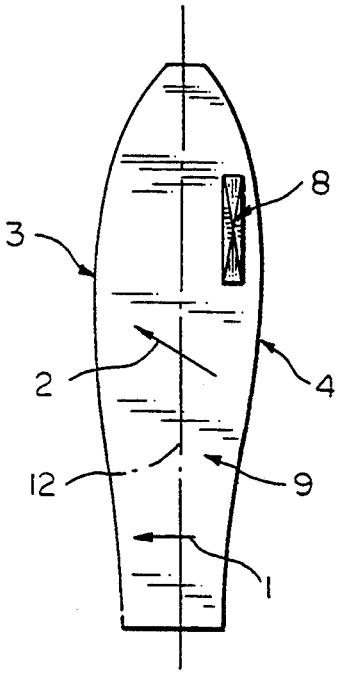
FIGS. 3, 4, 5, 6 and 7 illustrate a other embodiments.
Figure 7:
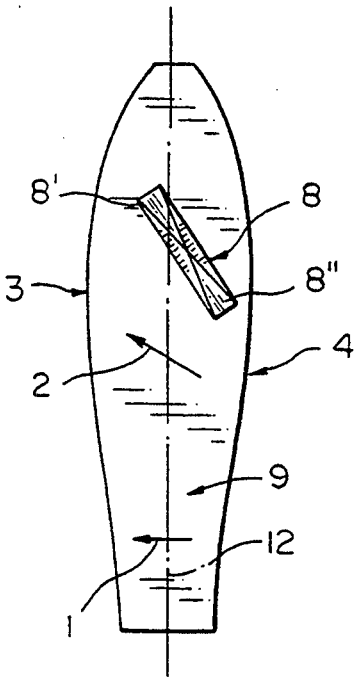

In this regard, FIGS. 3 to 7 illustrate a few possible embodiments among many others:

In FIGS. 3 and 7, only one vibration absorption element 8 is mounted on the surfboard, this absorber being placed predominantly on back side 4 according to the invention.

Figure 4:
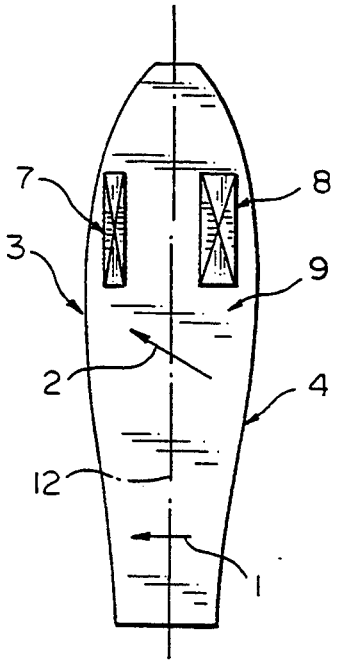

In FIG. 4, the two above-mentioned vibration absorption elements 7 and 8 have the same length, but element 8 mounted on the back side 4 is wider than the other element 7. As a variation, these two elements 7 and 8 may have the same length and width, but the thickness of the viscoelastic material of element 8 in this case would be different from that of element 7.

Figure 5:
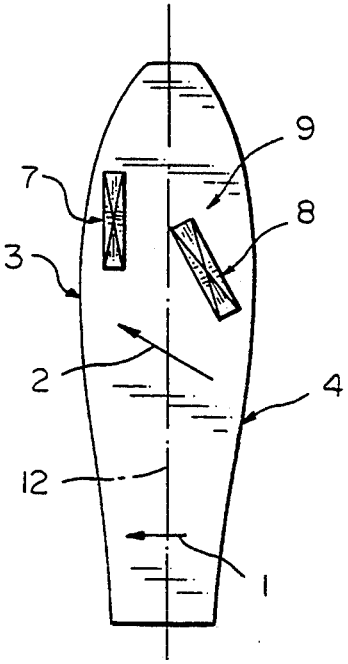

According to FIG. 5, vibration absorber 8 is placed at a slant with respect to the longitudinal axis of the surfboard, thus causing the vibration absorption to be distributed differently than the absorption produced by vibration absorber 7, which is parallel to the axis and distant therefrom.

Figure 6:
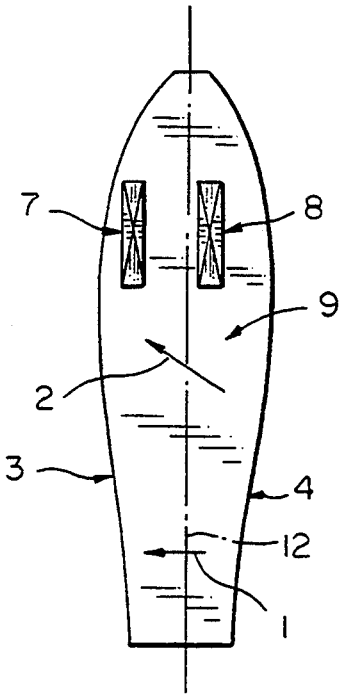

According to FIG. 6, vibration absorbers 7 and 8 are, for example, identical but vibration absorber 8 is closer to longitudinal axis 12 of the surfboard than vibration absorber 7.

According to FIG. 7, only one vibration absorber 8 is provided, which is slanted with respect to longitudinal axis 12 of the surfboard, and which cuts the latter so that its part 8′ on front side 3 has a smaller surface area than its part 8″ on back side 4.

For vibration absorbers outside of the structure of the surfboard, an additional advantage of the invention lies in the fact that the same basic product can both meet the needs of "goofy" and "regular" footed surfers because the vibration absorption plates are not pre-positioned on the surfboard by the manufacturer, but are positioned by the user himself.

In practice, it will be advantageous to provide indications (for example, using serigraphy) on each surfboard so that, after purchasing the product, "goofy" or "regular" users themselves can position the corresponding vibration absorption devices at the locations indicated in this manner.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A snow surfboard having asymmetric characteristics, comprising a gliding board having an upper surface constituting means for supporting a person thereon oriented askew relative to the length of said board, said board being totally symmetric with respect to its median longitudinal axis, said board having a back side and a front side, the distance between which constitutes a width of said board, but wherein, in order to give it asymmetric behavior characteristics, said gliding board is provided with a vibration absorption device composed of at least one vibration absorption element (7, 8), said vibration absorption device (7, 8) having a relatively small mass and being positioned asymmetrically with respect to a median longitudinal axis (12) of said surfboard and extending only art way across the width of said board, so that absorption created by said absorption device is preponderantly on said back side (4) of said surfboard.

2. Snow surfboard according to claim 1, wherein said absorption device comprises one vibration absorption element (8) placed on back side (4) of said surfboard aligned substantially parallel to said median longitudinal axis.

3. Snow surfboard according to claim 1, wherein said absorption device comprises one vibration absorption element (8) which is placed at a slant with respect to said longitudinal axis (12) of the surfboard and which transects said longitudinal axis so that its front side part (8′) has a smaller surface area than its back side part (8″).

4. Snow surfboard according to claim 1, wherein said absorption device comprises a pair of vibration absorption elements (7, 8) which have dimensions so that vibration absorption on said back side (4) is greater than the vibration absorption (7) on front side (3).

5. Snow surfboard according to claim 1, wherein said absorption device comprises a pair of vibration absorption elements (7,8) which are positioned so that vibration absorption on said back side (4) is greater than the vibration absorption (7) on front side.

6. Snow surfboard according to claim 1, wherein the vibration absorption device is external and indications are placed on the surfboard to allow "goofy" or "regular" users themselves to position said vibration absorption device (7, 8) where indicated.

7. Snow surfboard according to claim 1, wherein the vibration absorber is outside and comprises at least one vibration absorption element composed of a layer of viscoelastic material held in place by a high elasticity module plate.

8. Snow surfboard according to claim 1, wherein the vibration absorber comprises at least one vibration absorption element including a viscoelastic material.

9. Snow surfboard according to claim 2, wherein the vibration absorption device is external and indications are placed on the surfboard to allow "goofy" or "regular" users themselves to position said vibration absorption device (7, 8) where indicated.

10. Snow surfboard according to claim 2, wherein the vibration absorber is outside and comprises at least one vibration absorption element composed of a layer of viscoelastic material held in place by a high elasticity module plate.

11. Snow surfboard according to claim 3, wherein the vibration absorber is outside and comprises at least one vibration absorption element composed of a layer of viscoelastic material held in place by a high elasticity module plate.

12. Snow surfboard according to claim 4, wherein the vibration absorption device is external and indications are placed on the surfboard to allow "goofy" or "regular" users themselves to position said vibration absorption device (7, 8) where indicated.

13. Snow surfboard according to claim 4, wherein the vibration absorber is outside and comprises at least one vibration absorption element composed of a layer of viscoelastic material held in place by a high elasticity module plate.

14. Snow surfboard according to claim 5, wherein the vibration absorption device is external and indications are placed on the surfboard to allow "goofy" or "regular" users themselves to position said vibration absorption device (7, 8) where indicated.

15. Snow surfboard according to claim 5, wherein the vibration absorber is outside and comprises at least one vibration absorption element composed of a layer of viscoelastic material held in place by a high elasticity module plate.

16. A snow surfboard having asymmetric characteristics, comprising:

a gliding board having a median longitudinal axis (12) and which is totally symmetrical with respect to said median longitudinal axis, said board having a back side (4) and a front side (3), the distance between which constitutes a width of said board, and an upper surface constituting means for supporting two feet of a person thereon with at least one of the feet being oriented at an angle from said median longitudinal axis of 10° to 45°; and asymmetric behavior means for providing said board with asymmetric behavior characteristics, said asymmetric behavior means comprising an exterior vibration absorption device capable of placement by a user and composed of at least one vibration absorption element (7, 8) extending at least partly in the longitudinal direction of said board, said vibration absorption device being disposed preponderantly along said back side (4) of said surfboard and having a small mass relative to said board and positioned asymmetrically with respect to said median longitudinal axis so as to extend only part way across the width of said board.

17. A snow surfboard according to claim 16, wherein said absorption device comprises a pair of vibration absorption elements (7, 8) which have dimensions so that vibration absorption on said back side (4) is greater than the vibration absorption (7) on said front side (3).

18. Snow surfboard according to claim 16, wherein said absorption device comprises a pair of vibration absorption elements (7, 8) which are positioned so that vibration absorption on said back side (4) is greater than the vibration absorption (7) on said front side.

19. A snow surfboard according to claim 16, wherein said vibration absorption device comprises at least one vibration absorption element composed of a layer of viscoelastic material.

20. A snow surfboard having asymmetric characteristics, comprising:

a gliding board having a median longitudinal axis (12) and which is totally symmetrical with respect to said median longitudinal axis, said board having a back side (4) and a front side (3), the distance between which constitutes a width of said board, and an upper surface constituting means for supporting two feet of a person thereon with at lest one of the feet being oriented at an angle from said median longitudinal axis of 10° to 45°; and asymmetric behavior means for providing said board with asymmetric behavior characteristics, said asymmetric behavior means comprising a vibration absorption device composed of a pair of vibration absorption elements (7, 8) which have dimensions so that vibration absorption on said back side (4) is greater than vibration absorption on said front side, said vibration absorption device having a small mass relative to said board and being positioned asymmetrically with respect to said median longitudinal axis so as to expand only part way across the width of said board, wherein said vibration absorption elements are aligned substantially parallel to said median longitudinal axis, a first said vibration absorption element being disposed midway between said median longitudinal axis and said back side, and a second of said pair of vibration absorption elements being disposed substantially midway between said front side and said median longitudinal axis, said vibration absorption elements being composed of a layer of viscoelastic material held in place by a high elasticity module plate.

* * * * *